United States Patent [19]

Niemelä

[11] Patent Number: 4,520,582

[45] Date of Patent: Jun. 4, 1985

[54] SKI TRAILS ROTARY CUTTER AND CRUSHER DRAG UNIT

[76] Inventor: Tapio Niemelä, Linnatie 10 D 5, 99100 Kittilä , Finland

[21] Appl. No.: 586,994

[22] Filed: Mar. 7, 1984

[30] Foreign Application Priority Data

Mar. 18, 1983 [FI] Finland ..... 830907

[51] Int. Cl.[3] ..... E01H 4/00

[52] U.S. Cl. ..... 37/222; 172/69; 172/154

[58] Field of Search ..... 37/221, 222, 220; 172/153, 154, 158, 184, 187, 69

[56] References Cited

U.S. PATENT DOCUMENTS

| | | | |
|---|---|---|---|
| 31,738 | 3/1861 | Quinby | 172/69 |
| 43,808 | 8/1864 | Wadsworth | 172/69 |
| 195,198 | 9/1877 | Woodgate | 172/154 |
| 1,313,008 | 8/1919 | Oakes | 172/69 |
| 1,650,400 | 11/1927 | Stark | 172/69 |
| 2,751,205 | 6/1956 | Petersen | 172/184 |
| 3,739,859 | 6/1973 | White | 37/222 |
| 4,021,942 | 5/1977 | Purdy | 37/222 |
| 4,056,328 | 11/1977 | Maxey | 37/222 X |
| 4,163,329 | 8/1979 | Neff | 37/222 |
| 4,348,825 | 9/1982 | Bachler | 37/222 |

*Primary Examiner*—E. H. Eickholt

[57] ABSTRACT

Apparatus for making ski trails which is towed and comprises a drag having a cutter unit and a snow crushing unit mounted behind the cutter unit on the drag. The units have radial blades and rotate about an axis transverse to the direction of travel of the apparatus. The cutter unit derives its rotary motion from the tamped track of the snow and is connected by a transmission to the crushing unit whereby the latter derives its rotary motion from the cutter unit.

3 Claims, 3 Drawing Figures

SKI TRAILS ROTARY CUTTER AND CRUSHER DRAG UNIT

The present invention concerns a means for making ski trails, intended to be towed for instance behind a snowmobile, consisting of a drag provided with a cutter unit rotating about an axis transversal to the direction of travel and breaking up the tamped track, said unit deriving its rotation from the tamped track, and said cutter unit carrying radial blades; and of a means following after the drag and shaping the ski trail grooves.

A means for making ski trails of this type has been disclosed, for instance, in the Finnish patent application No. 813868. The object of the present invention is to develop further these means and to produce even better trails. The means for making ski trails of the invention is characterized in that behind the cutter unit is provided a snow crushing unit, this too rotating about an axis transversal to the direction of travel, and this unit carrying radial snow crushing blades; and that the crushing unit is by a transmission connected with the cutter unit, receiving its rotary motion therefrom. The cutter unit proper derives its rotation from the tamped track, its blades breaking up the tamped track surface at the same time. A lifting blade transversal to the direction of travel, and which is a component of the drag, simultaneously detaches a snow clod mat of a few centimeters, which passes to the crushing unit. The blades of the crushing unit now comminute the snow clods to a snow mass so finely ground that the trail groove shaping means following after the drag will establish an absolutely top-class skiing trail.

An advantageous embodiment of the invention is characterized in that the transmission ratio from the cutter unit to the crushing unit is such that the speed of rotation of the crushing unit is considerably higher than that of the cutter unit, for instance two- to threefold. Experiments have shown that about two- to threefold speed of rotation of the crushing unit compared with the cutter unit produces a snow mass fully well enough comminuted.

Another advantageous embodiment of the invention is characterized in that the blades of the crushing unit have been so turned that as they are crushing the snow clods they also guide the ground snow mass into the middle of the trail that is being established. Therefore, more snow is brought to the trail proper, where the consumption and packing of snow will be concentrated when the trail is in use.

Figure 1:
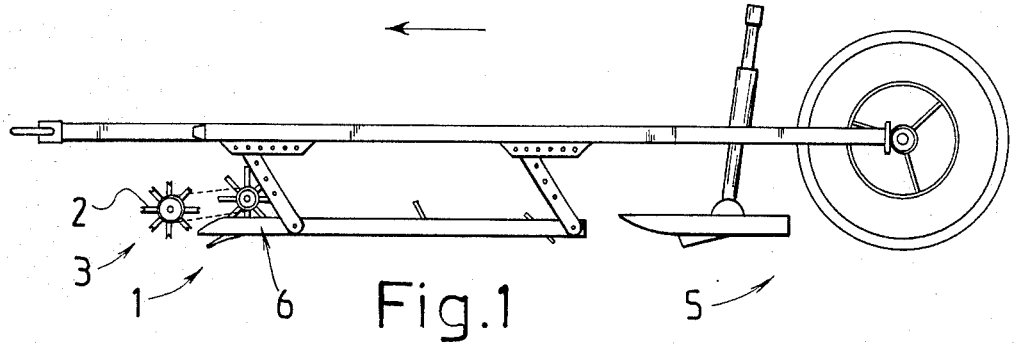

The invention is described in the following with the aid of an example referring to the drawing attached, wherein FIG. 1 presents the trail making means in elevational view.

Figure 2:
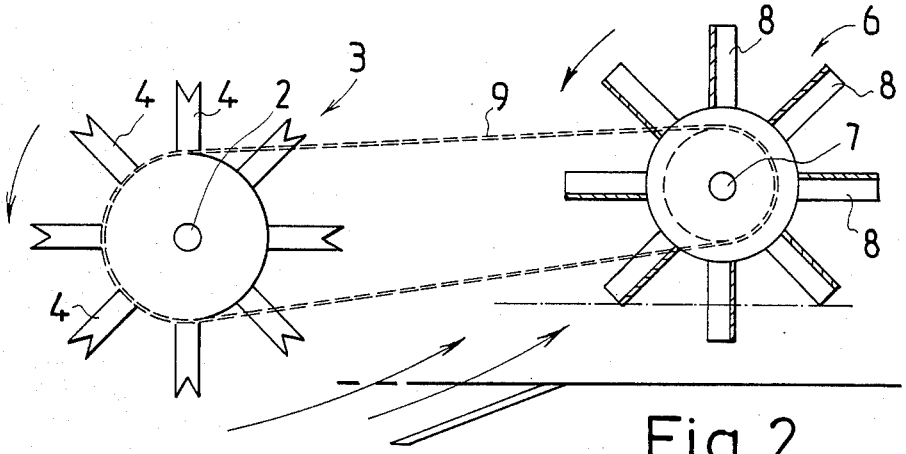

FIG. 2 presents the cutter and crushing units, enlarged.

Figure 3:
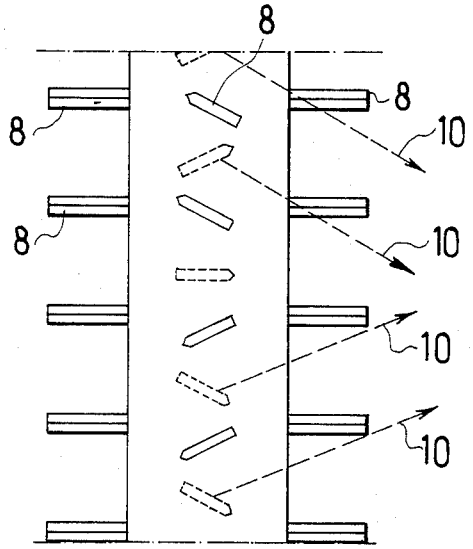

FIG. 3 shows the central part of the crushing unit, viewed from above.

The ski trail making means consists of a drag 1, provided with a cutter unit 3 rotating about an axis 2 transversal to the direction of travel of the means and breaking up the tamped track surface, said cutter unit deriving its rotary motion from the tamped track, and said cutter unit 3 carrying radial blades 4. Behind the drag 1 is disposed a means 5 shaping the trail grooves. The cutter of the cutter unit 3 includes a snow crushing unit 6, likewise rotating about an axis 7 transversal to the direction of travel of the means and carrying radial snow crushing blades 8. The crushing unit 6 is by a transmission 9 connected to the cutter unit 3, deriving therefrom its rotary motion. The transmission ratio between the cutter unit and the crushing unit 6 is such that the speed of rotation of the crushing unit is considerably higher than that of the cutter unit, for instance two- to threefold. The blades 8 of the crushing unit 6 are so turned that while crushing the snow clods they also direct the comminuted snow mass into the middle of the trail that is being formed, as indicated by arrows 10.

It is obvious to a person skilled in the art that the invention is not confined to the example described but may vary within the claims to be presented below. For instance, the combination of a cutter unit and crushing unit need not necessarily be connected to the specific trail making means presented in the example: they may equally be installed on trail making means of other types.

I claim:

1. Apparatus for making ski trails, and apparatus being adapted to be towed and comprising a drag, a cutter unit mounted on the drag rotatable about an axis transverse to the direction of travel of the apparatus, said cutter unit carrying radial blades and being operable to break up tamped tract surface of snow and deriving its rotary motion from the tamped track surface, means for shaping trail grooves disposed behind the drag, a snow-crushing unit carrying radial snow crushing blades mounted on the drag behind the cutter unit rotatable about an axis transverse to the direction of travel of the apparatus, and transmission means connecting the crushing unit to the cutter unit, whereby the crushing unit derives its rotary motion from the cutting unit.

2. Apparatus according to claim 1, wherein said transmission means is arranged such that the speed of rotation of the crushing unit is two to three times that of the cutter unit.

3. Apparatus according to claim 1, wherein the blades of the crushing unit are turned such that they are operable to guide finely ground snow mass to the middle of a trail being formed while simultaneously crusing snow clods.

* * * * *